US008677543B2

(12) United States Patent
Wilkins

(10) Patent No.: US 8,677,543 B2
(45) Date of Patent: Mar. 25, 2014

(54) FLUID-POWERED CLEANING DEVICE

(76) Inventor: Larry C. Wilkins, Ft. Lauderdale, FL (US)

( * ) Notice: Subject to any disclaimer, the term of this patent is extended or adjusted under 35 U.S.C. 154(b) by 1016 days.

(21) Appl. No.: 12/256,253

(22) Filed: Oct. 22, 2008

(65) Prior Publication Data

US 2009/0100617 A1 Apr. 23, 2009

Related U.S. Application Data

(60) Provisional application No. 60/981,908, filed on Oct. 23, 2007.

(51) Int. Cl.
*A46B 13/06* (2006.01)
*A47L 13/10* (2006.01)

(52) U.S. Cl.
USPC ..... 15/24; 15/50.3; 15/52.1

(58) Field of Classification Search
USPC ..... 15/24, 29
IPC ..... A46B 13/06; A47L 11/282
See application file for complete search history.

(56) References Cited

U.S. PATENT DOCUMENTS 5,129,121 A * 7/1992 Gelman ..... 15/29
2007/0089252 A1* 4/2007 Wilkins ..... 15/50.3

* cited by examiner

*Primary Examiner* — Monica Carter
*Assistant Examiner* — Stephanie Berry
(74) *Attorney, Agent, or Firm* — Finnegan, Henderson, Farabow, Garrett & Dunner, L.L.P.

(57) ABSTRACT

An apparatus for cleaning (e.g., scrubbing, washing, treating, waxing, etc.) a surface, such as a recessed crevice or area, includes a fluid-powered scrubber head and a removable brush extending from the scrubber head. The scrubber head includes a housing, an inlet at one end of the housing for receiving a flow of fluid from a fluid supply and a deflecting surface for directing the flow of fluid once received through the inlet. The deflecting surface may be a movable deflecting panel that is selectively moved relative to the housing to cover an opening in the housing. The deflecting surface may also include a partial conical surface that concentrates the flow of fluid deflected out of the housing and onto the brush outside the housing as the brush rotates in response to the fluid flow.

18 Claims, 11 Drawing Sheets

FLUID-POWERED CLEANING DEVICE

This application claims the benefit of priority under 35 U.S.C. §119(e) of U.S. Provisional Application No. 60/981,908, filed on Oct. 23, 2007, the disclosure of which is incorporated herein by reference.

This application relates in subject matter to pending U.S. patent application Ser. No. 11/254,647, U.S. patent application Ser. No. 11/866,172, and U.S. patent application Ser. No. 12/090,438.

FIELD OF THE DISCLOSURE

The present disclosure relates to devices and methods for cleaning surfaces. In particular, the present disclosure relates to fluid-powered cleaning devices and related methods.

BACKGROUND

Conventional devices for cleaning relatively large and/or difficult to reach areas are known, but may suffer from a number of possible drawbacks. For example, cleaning devices having a long handle and a brush for scrubbing are known for facilitating the cleaning of surfaces having, for example, a relatively large surface area and/or surfaces that may be difficult to reach, such as surfaces located overhead. Additionally, some vehicles and/or vehicle trailers may present relatively large and sometimes difficult to reach surfaces for cleaning, and cleaning such surfaces may be rendered less difficult or tiring by the use of, for example, a long-handled cleaning brush.

Such brushes, however, may suffer from a number of possible drawbacks. For example, such devices may not configured to supply treatment materials such as, for example, cleansers, polishes, and disinfectants, while the brush is being applied to the surface being cleaned. Rather, a person using the brush may need to withdraw the brush from the surface and dip the brush into a supply of treatment material. This may be inconvenient and hasten fatigue of the user. Further, such devices may not include a way to supply water to the surface being cleaned without the use of an extra water dispensing device, such as a hose. As a result, the surface may become dry prior to rubbing the brush against the surface, which may serve to mar the finish of the surface being cleaned or otherwise treated. In addition, conventional brushes may not be sized or configured to clean within relatively smaller spaces, recesses, and crevices, such as, for example, between spokes in a vehicle wheel, around wheel wells, side view mirrors, and air deflectors.

Thus, it may be desirable to provide a cleaning device and related methods that mitigate or overcome one or more of the above-outlined possible drawbacks.

SUMMARY

In the following description, certain aspects and embodiments will become evident. It should be understood that the aspects and embodiments, in their broadest sense, could be practiced without having one or more features of these aspects and embodiments. Further, it should be understood that these aspects and embodiments are merely exemplary.

One aspect of the disclosure relates to an apparatus for scrubbing a surface. Generally described, the apparatus includes a fluid-powered scrubber head that has an inlet for receiving a flow of fluid from a fluid supply, and a deflecting surface for directing the flow of fluid once received through the inlet. The apparatus also includes a removable brush extending from the scrubber head, where the brush is attached outside the scrubber head and rotated in response to the directed flow of fluid.

Another aspect of the disclosure relates to an apparatus for scrubbing a surface that also has a fluid-powered scrubber head and a removable brush. The scrubber head includes a housing with an inlet at one end of the housing. The inlet receives a flow of fluid from a fluid supply. The housing also includes an adjustable nozzle within the housing for directing the flow of fluid once received through the inlet and a wheel rotatably mounted within the housing. The wheel receives the directed flow of fluid from the nozzle and rotates in response to received the flow of fluid from the nozzle. The removable brush has a mounting shaft rotatably connected to the wheel, wherein the brush extends from the outside of the housing and is rotated in response to rotation of the wheel. In yet another aspect of the disclosure, a more detailed apparatus is described for scrubbing or otherwise treating a surface. The apparatus includes a scrubber head having a housing. The housing has an inlet at one end coupled to a fluid supply and receives a flow of fluid from the fluid supply. An adjustable nozzle is disposed within the housing for directing the flow of fluid once received through the inlet. The scrubber head further includes a treatment material dispenser removably mounted within the housing. The treatment material dispenser holds treatment material, such as soap, cleanser, wax, or other surface cleaner or treatments, to be applied to the surface. The treatment material dispenser is rotatable in response to the flow of fluid, which permits a portion of treatment material to escape into the flow of fluid. The scrubber head further includes a wheel disposed within the housing, where the wheel has an axle rotatably mounted within the housing. In response to the flow of fluid, the wheel and axle rotate. A removable brush comprising bristle material configured about a mounting shaft is connected to the wheel. Specifically, the mounting shaft of the brush is operably connected to the axle of the wheel, wherein the removable brush extends from housing and rotates in response to rotation of the wheel. The scrubber head also includes a deflecting panel movably mounted to the housing to selectively cover an opening in the housing. The deflecting panel is disposed on the housing to direct the flow of fluid towards the removable brush when the deflecting panel covers the opening in the housing. A partial conical surface may also be used at an outlet defined by the deflecting panel to concentrate the fluid as it is directed towards the brush.

Additional advantages of the disclosure will be set forth in part in the description which follows, and in part will be obvious from the description, or may be learned by practice of the disclosed embodiments.

Aside from the structural and procedural arrangements set forth above, the embodiments could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this description, illustrate several exemplary embodiments and together with the description, serve to explain the principles of the embodiments. In the drawings.

DESCRIPTION OF EMBODIMENTS

Figure 1:
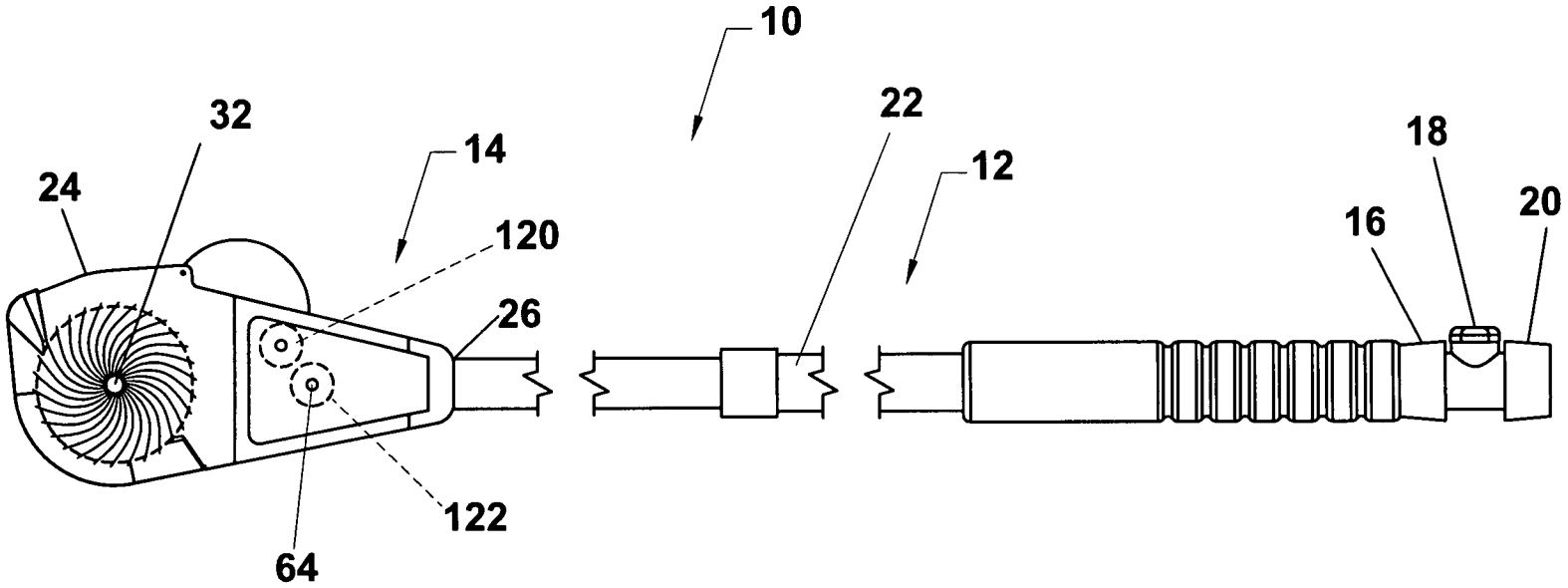
FIG. 1 is a schematic, side view of an exemplary embodiment of a cleaning device.

Reference will now be made in detail to a number of exemplary embodiments. Wherever possible, the same reference numbers are used in the drawings and the description to refer to the same or like parts.

As described here, an exemplary embodiment of a cleaning device that cleans or scrubs a surface. However, one skilled in the art will appreciate that cleaning the surface may also include treating the surface, such as disinfecting, applying wax/polish, removing rust or corrosion, creating visual effects (e.g., artful scratches such as a "brushed finish"), increasing the smoothness of the surface.

FIG. 1 shows a side view an exemplary embodiment of a cleaning device 10 in accordance with principles of the present invention. As shown in FIG. 1, exemplary cleaning device 10 includes a handle assembly 12 operably coupled to a scrubber head 14. Although shown in FIG. 1 as being operably coupled to handle assembly 10, scrubber head 14 may be used without handle assembly 12. According to the exemplary embodiment shown, handle assembly 12 may include a fitting 16 at one end for receiving a valve assembly 18, which, in turn, is configured to receive a supply of water via, for example, a hose 20 (e.g., a conventional garden hose). For example, valve assembly 18 may include an adjustable valve for controlling the flow of water into handle assembly 12, for example, a conventional garden hose control valve assembly. Handle assembly 12 includes a tubular portion 22 that may be length-wise adjusted, and the end of handle assembly 12 opposite valve assembly 18 is provided with a coupling for operably connecting handle assembly 12 to scrubber head 14.

According to the exemplary embodiment shown, cleaning device 10 may be used by attaching hose 20 to handle assembly 12. Valve assembly 18 may be adjusted by a user to control the flow of water into tubular portion 22. Water flows through tubular portion 22 and into scrubber head 14, and the user may use handle assembly 12 to apply scrubber head 14 of cleaning device 10 against a surface to be cleaned. As will be explained in more detail herein, scrubber head 14 may include one or more devices for treating (e.g., scrubbing) the surface being cleaned, and thus the user may use such devices to clean the surface by moving scrubber head 14 across and/or over the surface being cleaned or otherwise treated by the device. According to some embodiments, hose 20 may be coupled directly to scrubber head 14, and the user may apply scrubber head 14 to the surface being cleaned without the use of handle assembly 12.

As shown in FIG. 1, scrubber head 14 includes housing 24. For example, housing 24 may include two shells (e.g., molded plastic shells) secured to one another via at least one of welding and fasteners, such as, for example, nuts and bolts, screws, clamps, and/or rivets. Alternatively, the assembly of housing 24 may be molded as one piece.

Tubular portion 22 of handle assembly 12 may be formed from any suitable tubular device and may be rigid, flexible, and/or articulated. Handle assembly 12 may include a coupling (not shown) configured to couple tubular portion 22 to scrubber head 14. For example, the coupling may include a threaded portion and/or a quick disconnect-type coupling for being received in, for example, an internally-threaded socket 26 provided in housing 24 of scrubber head 14 (see, e.g., FIG. 2). Handle assembly 12 may include a coupling configured to couple tubular portion 22 to a supply of water, such as hose 20. For example, the coupling may include a threaded portion and/or a quick disconnect-type coupling for being operably coupled to hose 20, for example, a conventional garden hose. Accordingly, some embodiments of cleaning device 10 may be readily adapted for use with a conventional garden hose for, for example, propelling a scrubber, other cleaning device, and/or a supply (e.g., a cartridge) of treatment material associated with scrubber head 14. It is contemplated that sources of pressurized liquid other than a garden hose may be used in association with cleaning device 10.

Figures 2, 3:
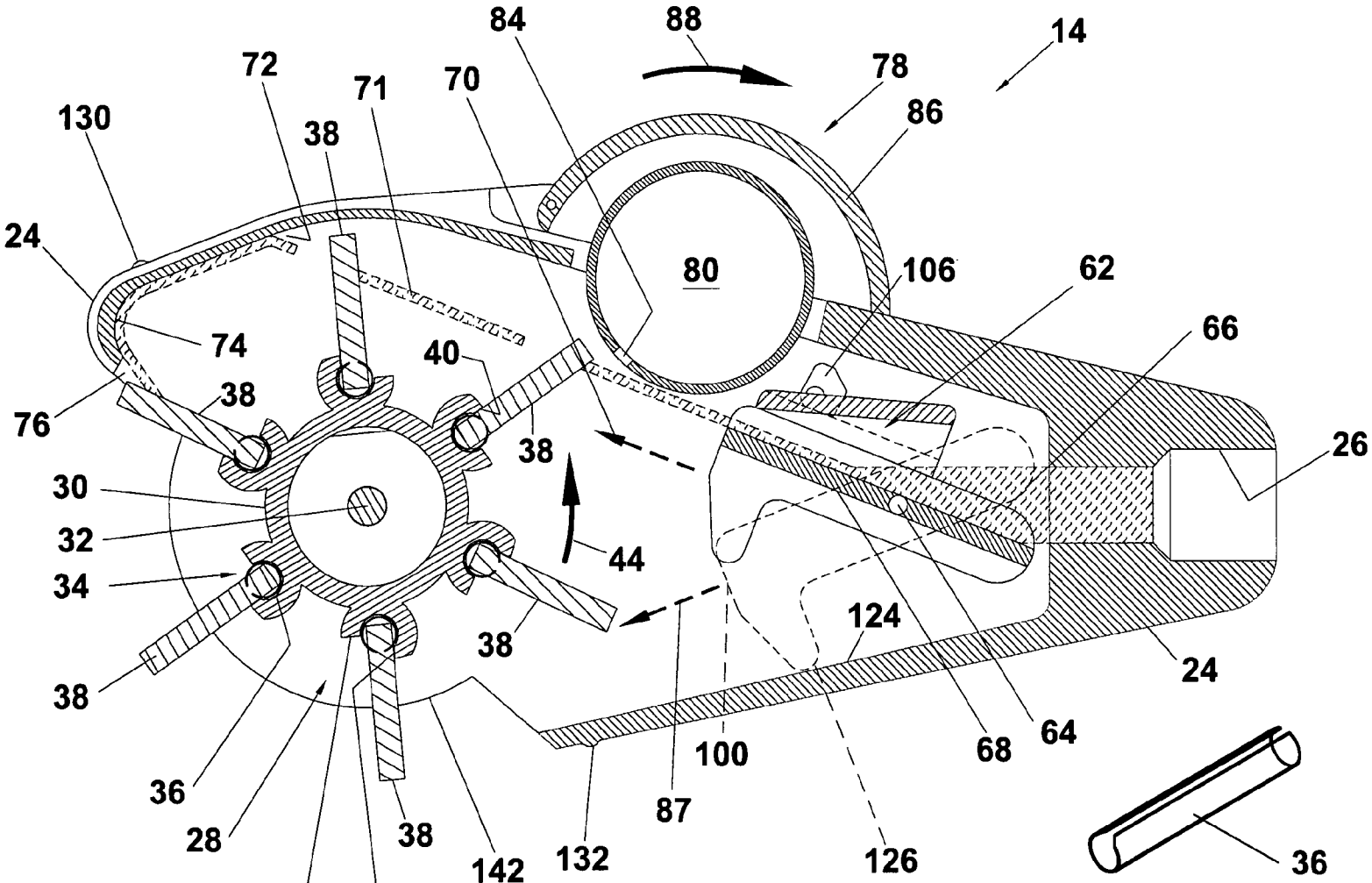
FIG. 2 is a schematic, partial section view along line 2-2 of FIG. 11.
FIG. 3 is schematic, perspective view of an exemplary embodiment of a scrubber pad retainer clip.

FIG. 2 shows a partial section view an exemplary embodiment of scrubber head 14. Referring now to FIG. 2, exemplary scrubber head 10 includes a scrubber wheel 28, which is configured to rotate on a hub 30 mounted on an axle 32. Exemplary hub 30 shown in FIG. 2 includes a plurality of radially-spaced receptacles 34 extending axially in a direction parallel to axle 32. One or more of receptacles 34 is partially cylindrical, as shown, and is configured to receive a retainer 36 of a scrubber member 38. For example, retainer 36 may include a split tube formed of, for example, plastic and/or metal (see FIG. 3), which is configured to receive scrubber member 38 by sliding scrubber member 38 into retainer 36 along its longitudinal axis. The split nature of exemplary retainer 36 serves to grip scrubber member in a secure but optionally removable fashion.

As shown in FIG. 2, retainers 36 are received in receptacles 34 of hub 30 of scrubber wheel 28. By virtue of the exemplary retainers 34 and receptacles shown, scrubber members 38 are pivotally retained in hub 30. When hub 30 spins, for example, without obstruction, scrubber members 38 extend radially outward relative to hub 30 for engagement with a surface area to be cleaned.

According to some embodiments, scrubber members 38 are used to contact the surface are being cleaned and scrub that surface while the scrubber member flexibly moves relative to the surface. In other embodiments, scrubber members 38 may be used to remove materials from a surface that are relatively difficult to remove. For such situations, scrubber members 38 may include a relatively course surface (e.g., a surface having a grit, such as Scotch-Brite®). It may be desirable for scrubber member 38's material to be relatively sturdy in order to remain resilient when impacted by the fluid flow and the surface being cleaned, particularly when scrubber members 38 are exposed to fluid. An example of material suitable for scrubber members 38 includes automobile floor carpeting media having "terry cloth" covering applied thereto, which may achieve desirable results when used, for example, in applications using water as a carrier medium for washing with soap and/or other cleaning material in the cartridge, or as the carrier medium for polishing and/or waxing with a liquid wax. According to the exemplary embodiment shown in FIG. 2, one or more of the receptacles 34 includes an outer stop 40 and an inner stop 42. Because the exemplary retainers 38 shown are generally cylindrical, retainers 34 are able to pivot within the receptacles 34 such that scrubber members 38 flexibly pivot between the outer stop 40 and inner stop 42.

As fluid enters exemplary scrubber head 14 at coupling 26, the fluid may be directed toward scrubber members 38. As shown in FIG. 2, for example, this will cause scrubber wheel 28 to rotate in counter-clockwise direction as indicated by arrow 44. As a user applies scrubber members 38 to a surface being cleaned, scrubber members 38 pivot against inner stops 42. Once the user discontinues applying scrubber members 38 against the surface being cleaned, however, scrubber members 38 pivot against outer stops 40 due to centrifugal force. As a result, fluid drives the scrubber members 38 forward such that scrubber wheel 28 continues to rotate.

Figure 4:
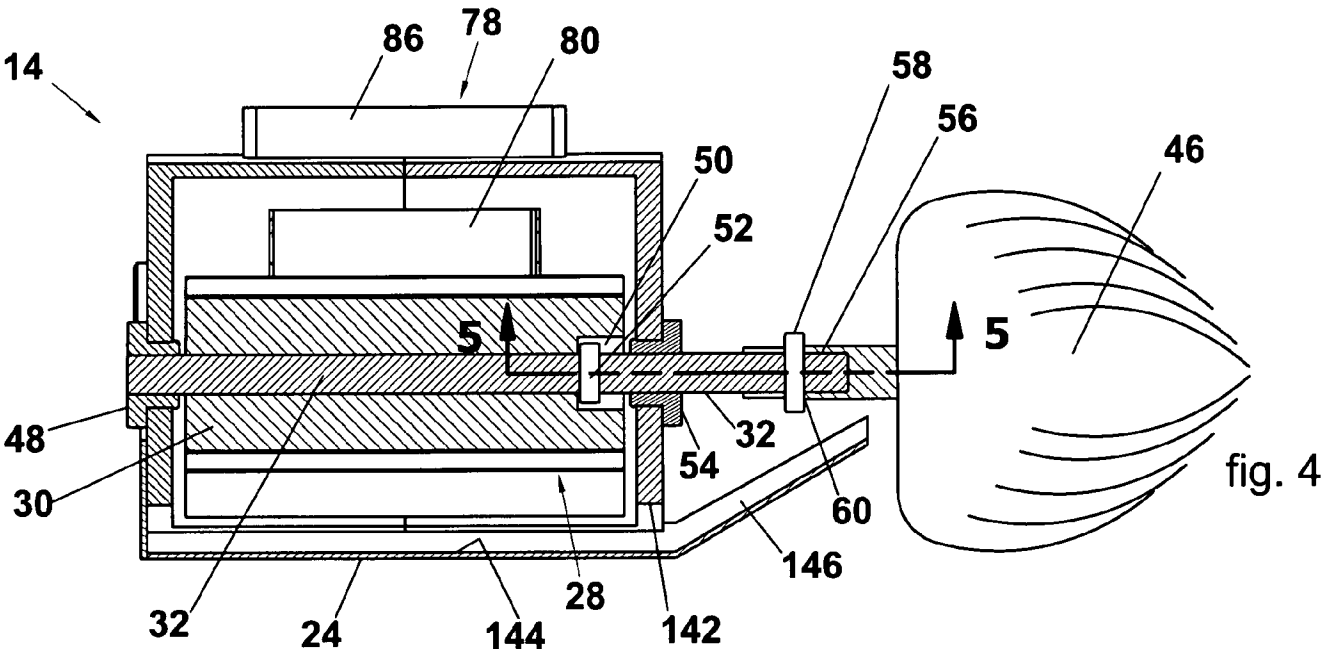
FIG. 4 is a schematic, partial section view along line 4-4 of FIG. 10.

According to some embodiments, cleaning device 10 may include a removably attachable brush 46, for example, as shown in FIG. 4. Brush 46 may include different types of bristles, configurations, and/or sizes based on desired use. For example, the bristles may be formed of one or more of natural fibers, synthetic fibers, and natural and/or synthetic strands or strips of material. While brush 46 is shown with bristles extending along the axis of axle 32, bristle 46 may have different sizes, shapes and extend out from axle 32 in different configurations. According to some embodiments, scrubber head 14 may be configured such that brush 46 rotates and is supplied with fluid and/or surface treatment material, as will be explained in more detail herein.

According to the exemplary embodiment shown in FIG. 4, axle 32 extends axially through hub 30 and has one end rotatably received in a bushing 48 that may be secured in one side of housing 24 and facing one end of hub 30. The other end of hub 30 may include a slot 50 (see FIGS. 4 and 5) having an open end that is slightly narrower than an inner end of slot 50, such that a pin 52 provides a snug fit with respect the open end of slot 50 and snaps into the slightly larger inner end of slot 50 to position axle 32 longitudinally relative to scrubber wheel 28. A bushing 54 may be secured in the other side of housing 24 of scrubber head 14, which faces the slotted end of hub 30.

Figure 5:
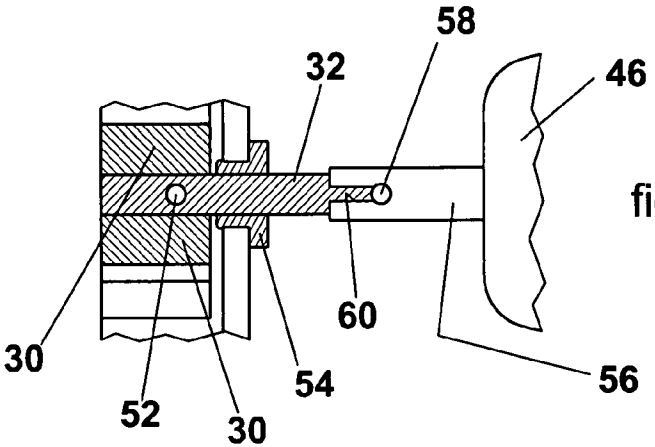
FIG. 5 is a schematic, partial section view along line 5-5 of FIG. 4.

According to some embodiments, brush 46 may be provided with a mounting shaft 56 having a tubular end configured to be received on axle 32. A pin 58 may be dimensioned to have a snug fit in axle 30, and pin 58 is received in a slot 60 (FIG. 5) which, similar to slot 50 of scrubber wheel 28, is narrower at the open end than the closed end. As brush 46 is pressed onto axle 32 in the illustrated embodiment, pin 58 will spread slot 60 during installation of brush 46 on axle 32, and snap into place at the wider space at the closed end of slot 60 (FIGS. 4 and 5). Pins 52 and 58 prevent, respectively, rotation of scrubber wheel 28 and brush 46 relative to axle 32.

According to some embodiments, scrubber wheel 28 may be removed from housing 24 by pulling axle 32 from left to right (as shown in FIG. 4). As pin 52, secure in axle 32, is pulled out of slot 50, the inside wall of housing 24 holds scrubber wheel 28. As axle 32 is pulled farther out, pin 58 pulls bushing 54 out of housing 24, and axle 32 may then be pulled freely the rest of the way out of housing 24. Thereafter, scrubber wheel 28 may be simply pulled or dropped out of an opening in housing 24. A different scrubber wheel (or the same one) may be installed in the reverse manner by simply placing scrubber wheel 24 in the opening and pushing axle 32 back through the hole in housing 24 and hub 30 and into bushing 48, followed by installing bushing 54. In this manner, a scrubber wheel with different textured scrubbing members may replace an existing scrubber wheel used in device 10.

According to some embodiments, scrubber wheel 28, when outside housing 24, may have individual scrubber members 38 replaced by simply pulling them axially out of receptacles 34 and replacing them with different ones (e.g., new ones). When scrubber wheel 28 is installed into housing 24, inside faces of housing 24's side walls (or other retaining devices) may be used to prevent scrubber members 38 from moving axially relative to receptacle 34.

According to some embodiments, for example, as shown in FIG. 2, scrubber head 14 may include a nozzle assembly 62 configured to direct the flow of fluid onto scrubber wheel 28. For example, nozzle assembly 62 is pivotally mounted on an axle 64 in housing 24, so that it is operable between a position, for example, as shown in solid lines in FIG. 2, to a position shown in dashed lines in FIG. 2.

In the exemplary position shown in FIG. 2 in solid lines, nozzle assembly 62 directs pressurized fluid 66 entering from coupling 26 of housing 24 upward on a deflector wall 68 of nozzle assembly 62 in a discharge direction shown by arrow 70, which engages the faces of scrubber members 38 adjacent the outer portion of each of scrubber members 38, causing rotation of scrubber wheel 28 in the direction of the arrow 44. Outer stops 40 of receptacles 34 on scrubber wheel 28 hold scrubber members 38 out such that the fluid force from deflector wall 68 of nozzle assembly 62 along fluid flow path 71 provides a strong rotational force on scrubber wheel 28.

As scrubber wheel 28 spins and the fluid 66 departs off the end of scrubber members 38, the fluid strikes an inside face of upper wall 72 of housing 24 and is deflected downward and into a reverse curve surface 74 located at an inside front portion of housing 24 above an outlet 76 of housing 24. At an upper edge of outlet 76, the direction of the remaining fluid flow is downward and rearward against the face of scrubber pads 38 moving downward away from the top of outlet 76, thereby providing additional thrust to scrubber wheel 28 for rotation in the direction of arrow 44. Scrubber member 38 is able to pivot backward as it strikes the surface being cleaned by cleaning device 10. As soon as scrubber member 38 leaves contact with the surface being cleaned, it again moves outward under centrifugal force and is ready for impact by the fluid along line 66 when scrubber member 38 moves upward and forward in housing 24, as scrubber wheel 28 rotates forward in the direction of arrow 44.

Figure 6:
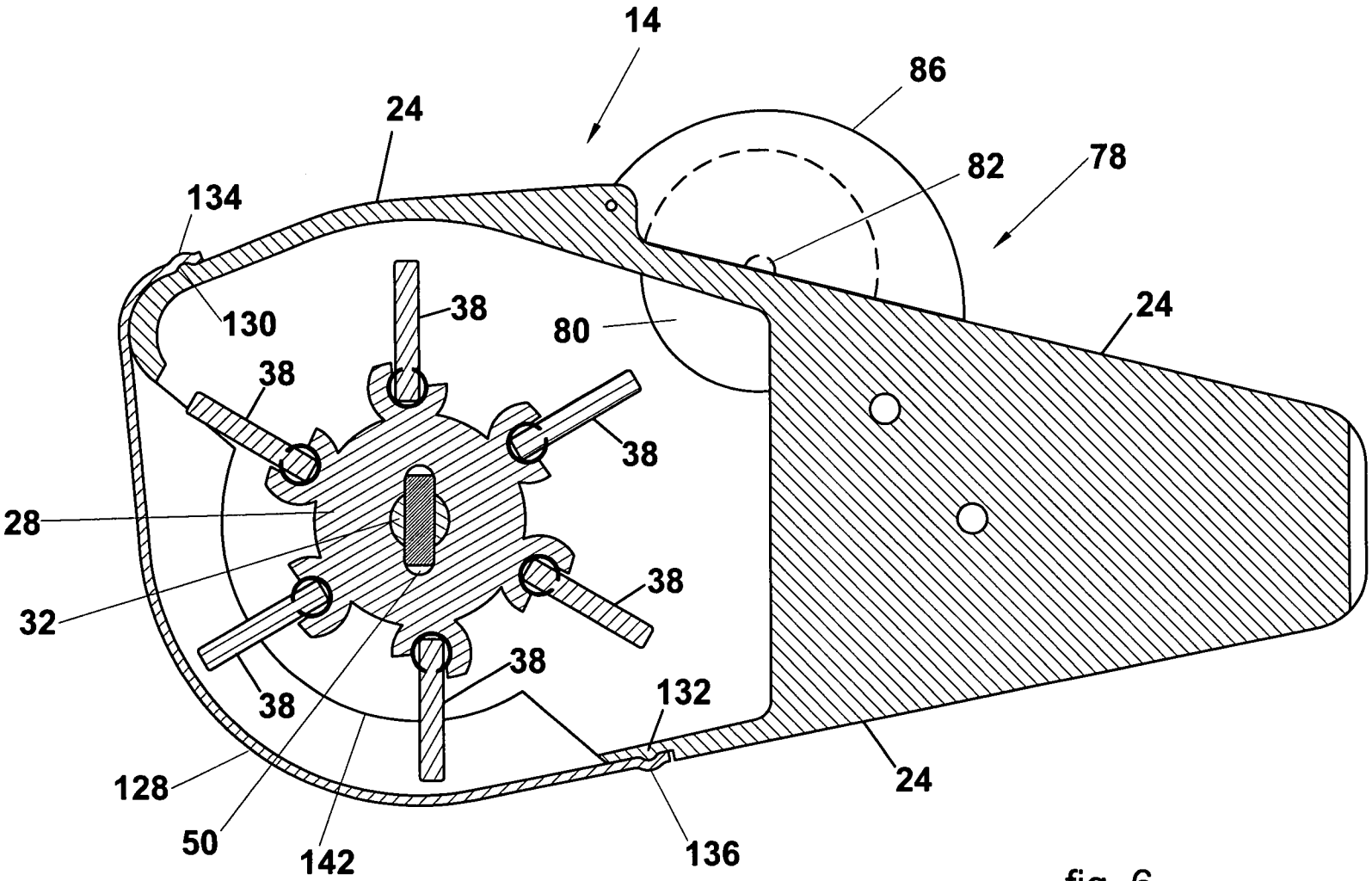
FIG. 6 is a schematic, partial section view along line 6-6 of FIG. 13.

According to some embodiments, cleaning device 10 may include a treatment material dispenser. For example, as shown in FIGS. 2 and 6, housing 24 may include a treatment material dispenser housing 78 configured to hold a treatment material cartridge 80 configured to provide a supply of treatment material. According to some embodiments, treatment cartridge 80 may be refillable. According to some embodiments, treatment cartridge 80 may be configured as a single use cartridge, e.g., a single-fill, disposable, or "throw-away" cartridge. Examples of treatment materials include, but are not limited to, cleaners, polishes, abrasives, and disinfectants.

According to some embodiments, treatment material cartridge 80 may include an axle 82 (e.g., axle pins on either end) (see FIG. 6) configured to facilitate rotation in treatment housing 78. Treatment cartridge 80 may define an outlet aperture 84 (FIG. 2) configured to permit treatment material to escape treatment cartridge 80 as it rotates in treatment housing 78. Various treatment materials (e.g., liquid treatment materials) in treatment cartridge 80 may be provided, depending on, for example, whether the task is cleaning, scrubbing, polishing, waxing, and/or otherwise treating the surface area to be operated on by scrubber members 38, and/or the surface (e.g., a recess or crevice) to be operated on by brush 46. Further, while the single opening 84 (e.g., a round opening) (see FIG. 2) in treatment cartridge 80 may be desirable, multiple openings and/or differing opening shapes can be provided according to, for example, the treatment material to be contained in treatment cartridge and/or other considerations.

According to some embodiments, treatment housing 78 may be partially defined by a housing lid 86, which may be hingedly secured to housing 24 of scrubber head 14 to provide access to treatment housing 78 in order to insert and remove treatment cartridges 80.

Referring to FIG. 2, according to some embodiments, as treatment cartridge 80 spins in treatment housing 78, a portion of treatment material escapes treatment cartridge 80 via outlet aperture 84 and into the interior of housing 24 of scrubber head 10, where it mixes with fluid flowing through housing 24. To cause treatment cartridge 80 to spin, nozzle assembly 62 may be adjusted slightly clockwise (as shown in FIG. 2) to deflect fluid flow from a direction 87 well below treatment cartridge 80, upward toward treatment cartridge 80, where fluid flow engaging the surface of treatment cartridge 80 spins treatment cartridge 80 in the clockwise direction of arrow 88. The speed of rotation and the consequent amount of treatment material discharged from treatment cartridge 80 may depend upon the size of the treatment cartridge 80 and how the fluid flow strikes a periphery of treatment cartridge 80.

Figure 7:
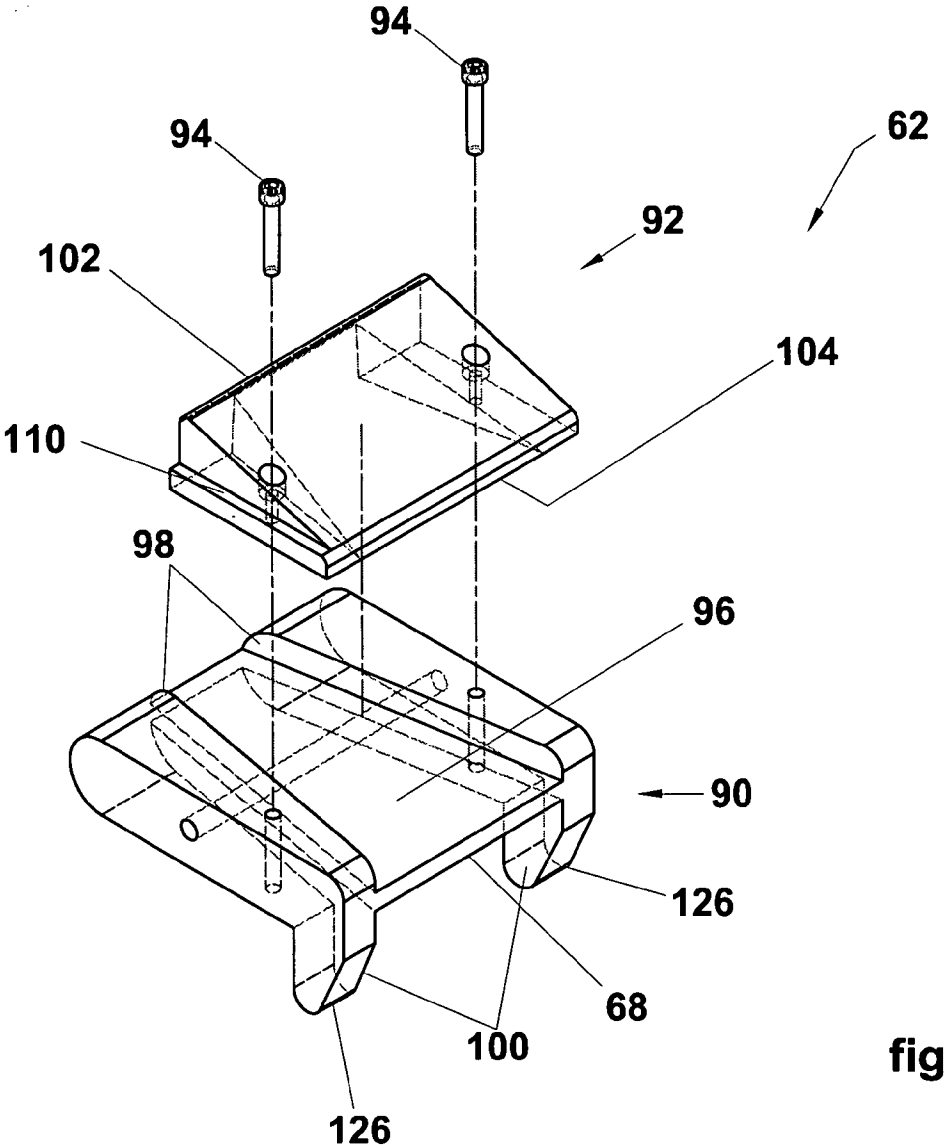
FIG. 7 is schematic, exploded view of an exemplary embodiment of a nozzle assembly.
Figure 8:
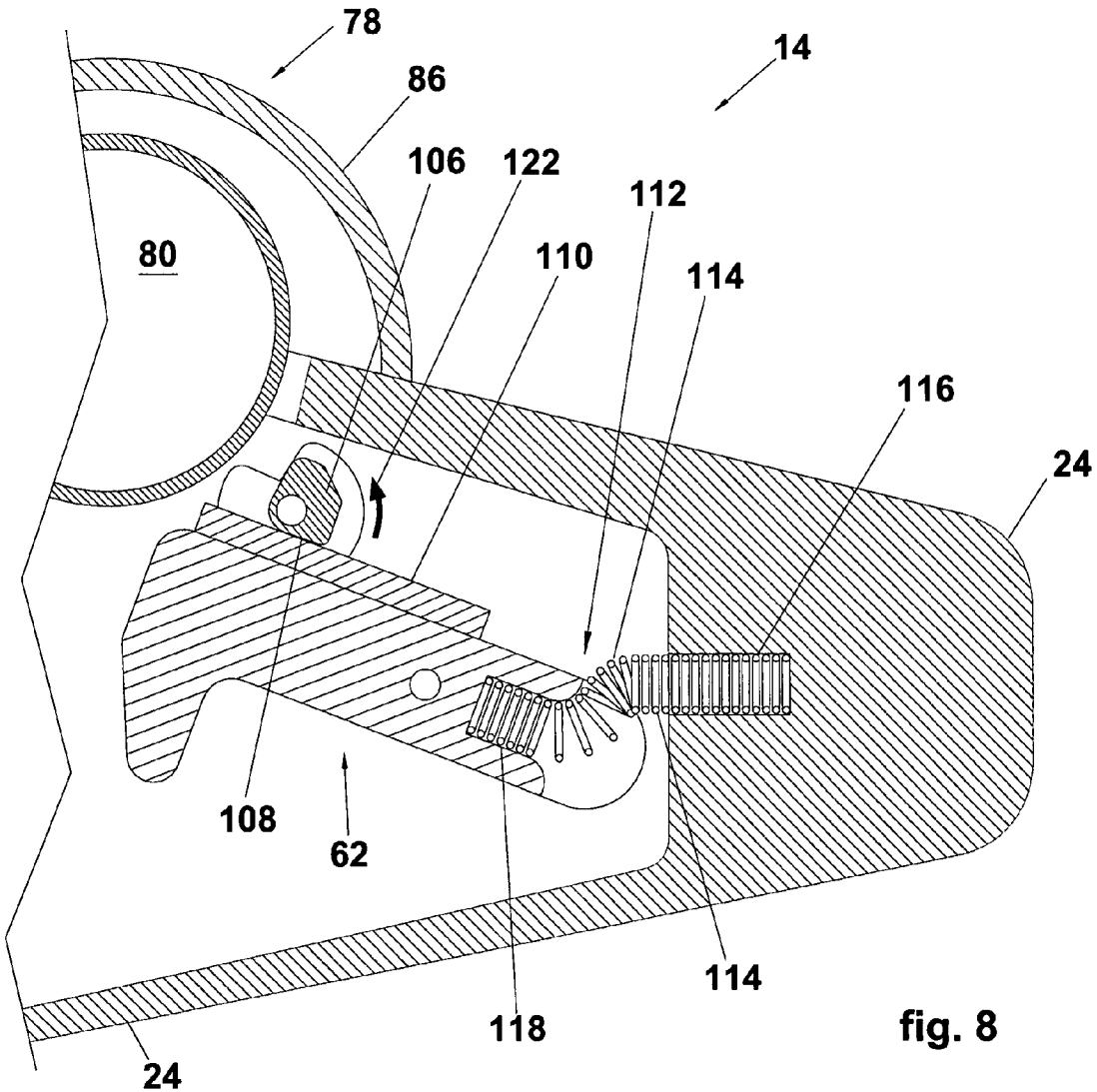
FIG. 8 is a schematic, partial section view along line 8-8 of FIG. 11.

Referring further to FIGS. 7 and 8, FIG. 7 shows an exploded view of exemplary nozzle assembly 62. Exemplary nozzle assembly 62 includes a deflector plate 90 and a deflector cap 92, which may be fastened to one another via welding and/or fasteners 94 (e.g., screws). Alternatively, assembly 62 may be molded as one piece.

Deflector plate 90 defines sides bridged by a wall 96 (i.e., deflector wall 86) having inside faces 98 above wall 96 and inside faces 100 below wall 96. According to some embodiments, the faces 98 and 100 are flared outward as shown in FIG. 7 to receive the pressurized fluid 66 entering housing 24 at a rear end of nozzle assembly 62. When nozzle assembly 62 is directed upward, for example, as shown in FIGS. 2 (in solid lines) and 8, the entering stream of fluid 66 can spread laterally across the width of scrubber members 38 on scrubber wheel 28. Deflector cap 92 of nozzle assembly 62 slopes downward and forward from a rear edge 102 to a front edge 104, across the width of nozzle assembly 62, converging toward the front of nozzle assembly 62, to avoid any overspray from the incoming stream of fluid from spinning of treatment cartridge 80 when it is not desired, as in the nozzle lower position where the direction of discharge is along arrow 87 in FIG. 2.

As shown in FIG. 8, exemplary nozzle assembly 62 includes a cam 106 defining a flat 108 (e.g., one of five flats) engaging a ledge 110 on nozzle assembly 62. Cam 106 serves to hold nozzle assembly 62 in a desired position. Exemplary nozzle assembly 62 includes a stabilizer 112. For example, stabilizer 112 may be in the form of a biasing member 114, such as, for example, a spring, as shown in FIG. 7. For example, one end of biasing member 114 is received in a socket 116 of housing 24, and another end of biasing member 114 is received a socket 118 in nozzle assembly 62.

According to some embodiments, sockets 116 and 118 are located in a plane laterally offset from the center of housing 24. Biasing member 114 serves to hold nozzle assembly 62 against the cam 106 in the attitude shown in FIGS. 2 and 8. This will cause treatment cartridge 80 to spin at high speed. Turning cam control knob 120 (FIG. 9) backward, opposite the direction of arrow 122 (FIG. 8) will force other cam flats in succession downward against ledge 110 of nozzle assembly 62, permitting biasing member 114 to tilt nozzle assembly 62 downward away from the position shown in FIG. 2 to the discharge direction 87 avoiding treatment cartridge 80, such that treatment cartridge 80 slows and/or discontinues rotating.

Figure 9:
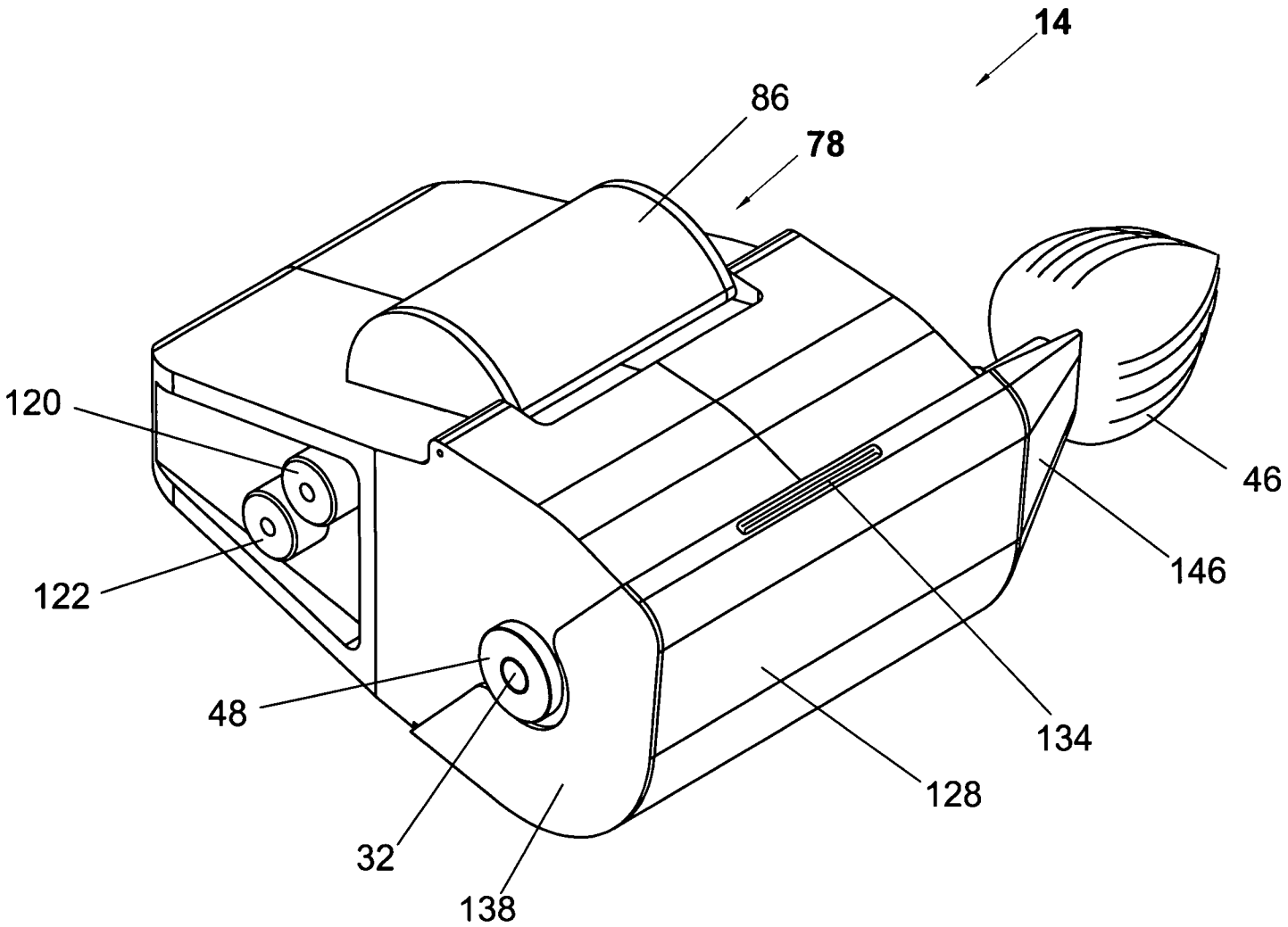
FIG. 9 is a schematic, front perspective view of an exemplary embodiment of a scrubber head.

According to the exemplary embodiment described, the foregoing series of steps for using cam control knob 120 moves nozzle assembly 62's deflector wall 68 away from the first position shown in FIG. 2 (in solid lines) where treatment cartridge 80 spins at higher speeds, to positions where treatment cartridge 80 spins at slower speeds or ceases to spin altogether. Thus, according to this exemplary embodiment, a user may conveniently adjust the rotational speed of treatment cartridge 80 via cam adjustment knob 120 (FIG. 9).

Figure 10:
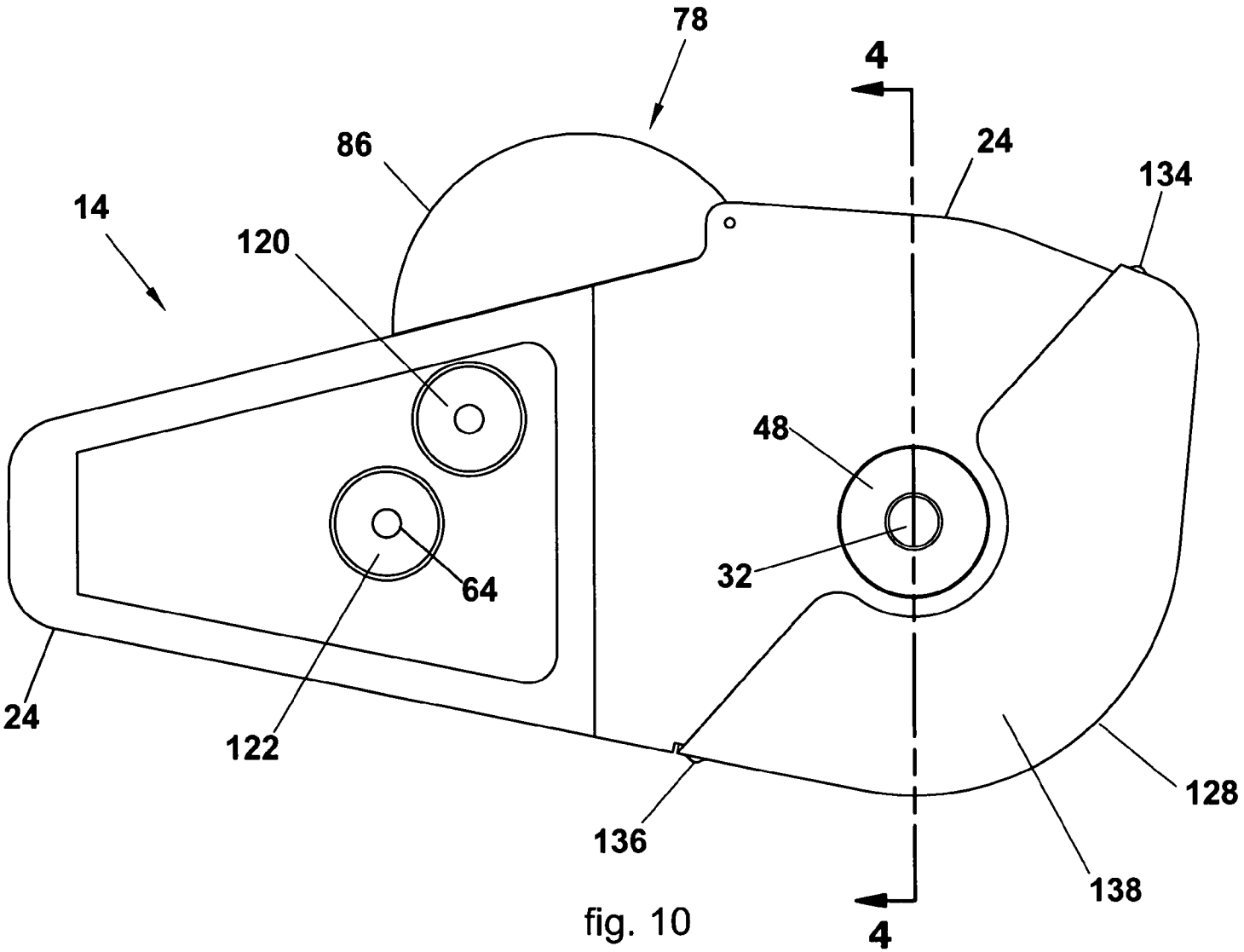
FIG. 10 is schematic, side view of the exemplary scrubber head shown in FIG. 2.
Figure 11:
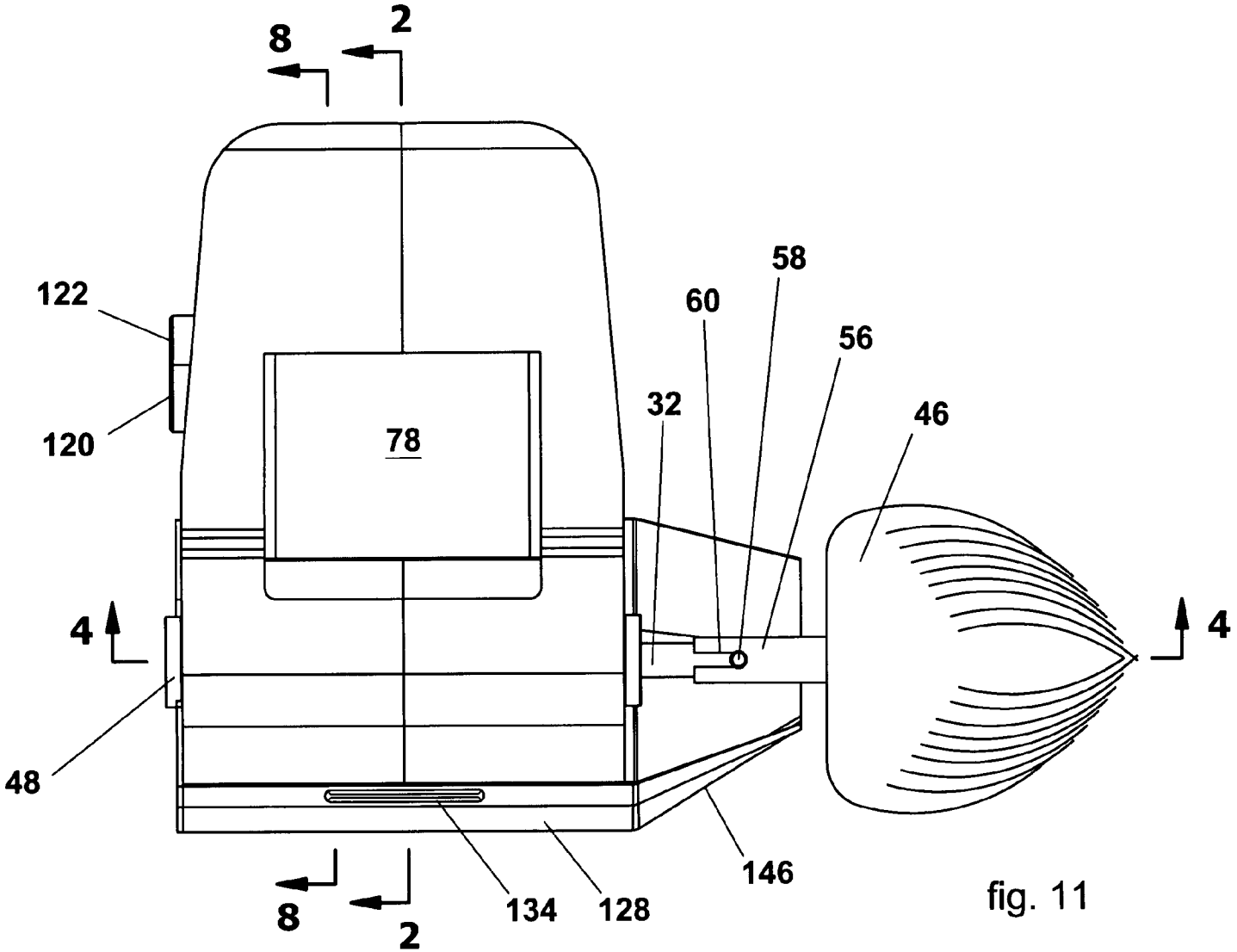
FIG. 11 is a schematic, top plan view of the exemplary scrubber head shown in FIG. 2.
Figure 12:
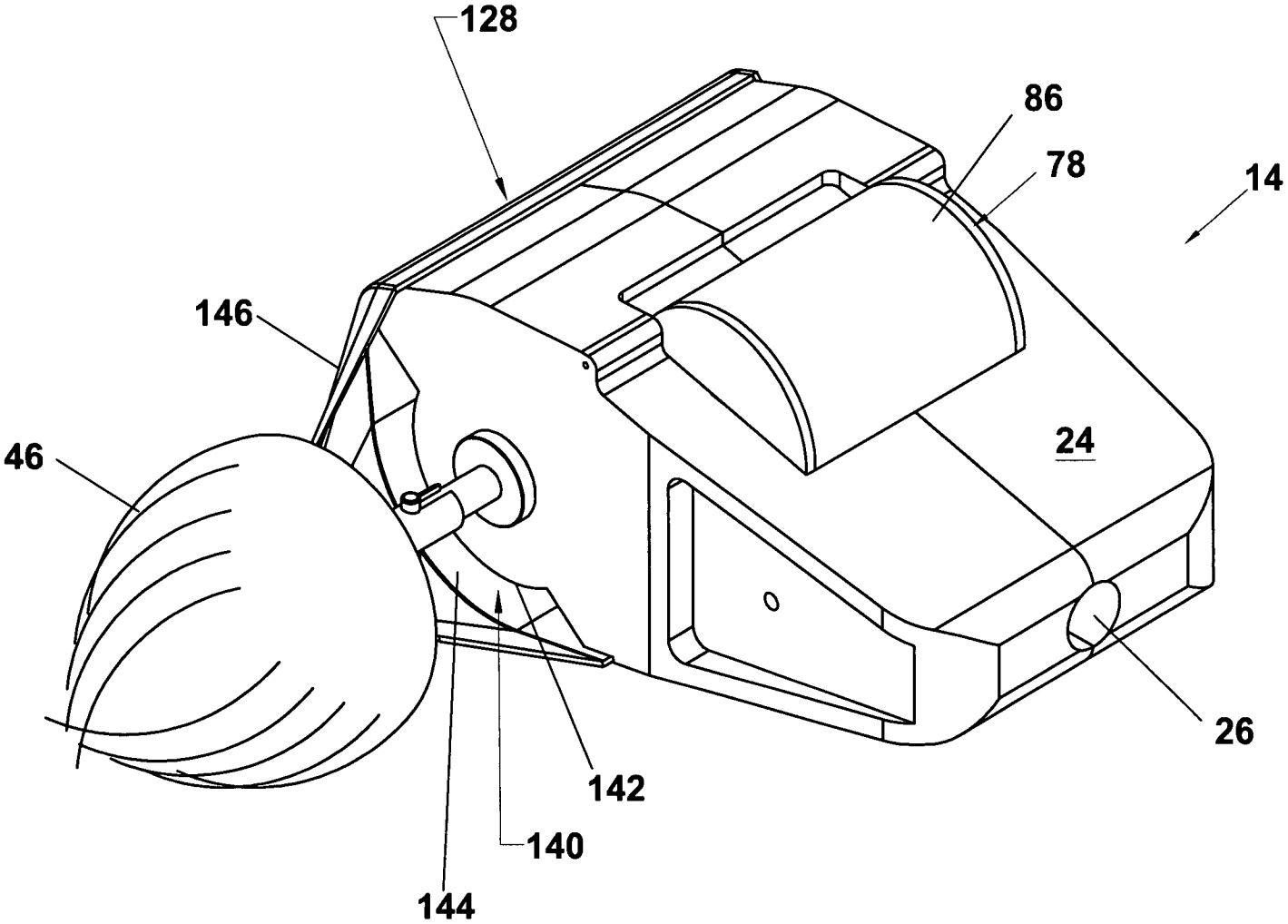
FIG. 12 is a schematic, perspective view of an exemplary embodiment of a scrubber head.
Figure 13:
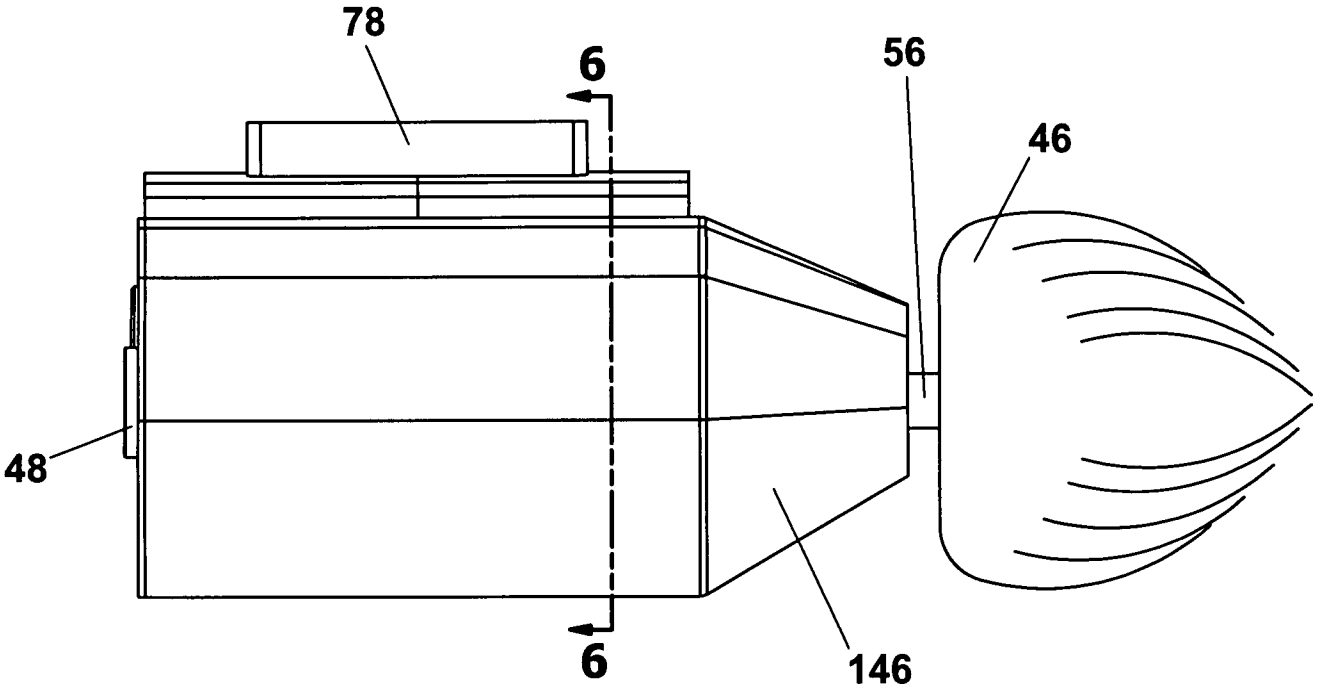
FIG. 13 is a schematic front elevation view of the exemplary scrubber head shown in FIG. 6.

Referring to FIGS. 10-12, exemplary scrubber head 14 includes a nozzle shifting knob 122, which is coupled to axle 64 of nozzle assembly 62. Nozzle shifting knob 122 is configured to adjust nozzle assembly 62, for example, between an upward attitude, such that fluid flow in housing 24 is directed along line 70, and a downward attitude, such that the fluid flow is directed along line 87 (see FIG. 2). In particular, deflector wall 68 intercepts the incoming fluid stream and directs it downward in the direction of arrow 87. During this exemplary shift of nozzle assembly 62, socket 118, which receives biasing member 114 (FIG. 7) moves above the axle 64, so that the biasing member 114 maintains the nozzle assembly 62 in a position which would direct the flow of fluid along arrow 87 (FIG. 2). This position would be maintained even if the fluid supply were shut off from scrubber head 14. The downward attitude of nozzle assembly 62 may be useful if, for example, the user cleaning device 10 does not want any of the water and/or treatment material to come backward toward the user as cleaning device 10 is moved forward over the surface to be cleaned. By turning nozzle shifting knob 122 in the opposite direction, nozzle assembly 62 pivots to a position in which fluid flow is directed along arrow 70.

According to some embodiments, scrubber wheel 28 may be configured (or positioned) such that outer and inner stops 40 and 42 relate to one another in a manner opposite the configuration (or position) shown in FIG. 2. Biasing member 114 acts to maintain the downward attitude of nozzle assembly 62 for such application. As shown in FIG. 2, for example, nozzle assembly may include projections 124 configured to abut a bottom interior wall 126 of housing 24, as shown in dashed lines in FIG. 2.

According to some embodiments, cleaning device 10 may be effective for cleaning large areas of a surface. Cleaning device 10 may be made relatively small for hand-held use or use within recesses, or relatively larger having, for example, a handle, such as handle portion 12. According to some embodiments, the speed of rotation of scrubber wheel 28 may be adjusted via, for example, adjusting valve assembly 18, which adjusts the flow of water from an external source, for example, from a conventional water supply system. Alternatively, or in addition, cleaning device 10 may use water supplied via a system having enhanced fluid pressure, such as, for example, a high pressure washer machine.

According to some embodiments, a supply of treatment material may be provided by a treatment cartridge (e.g., treatment cartridge 80), for example, by raising the attitude of nozzle assembly 62 to direct the flow of fluid to various degrees of contact with treatment cartridge 80 up to, for example, the level of attitude shown in solid lines in FIG. 2 to achieve a relatively high spin speed of treatment cartridge 80, thereby resulting in a higher rate of treatment material dispensing. Thus, ample power and scrubbing action may be obtained for larger areas.

Depending on the surface to be cleaned and/or the treatment material being dispensed from treatment cartridge 80, embodiments used for brush 46 may include natural and/or artificial bristles, fabrics, ropes, braids, and/or other types of surface treatment features for scrubbing, polishing, and/or waxing that conform with the particular treatment material used in device 10.

According to some embodiments, exemplary brush 46 may be incorporated into cleaning device 10 to clean, polish, and/or wax pockets, recesses, crevices, and/or other irregular surfaces. According to some embodiments, exemplary brush 46 may be removably mounted on the end of axle 32, and thus brush 46 may be configured to be driven at the same speed as scrubber wheel 28 (see, e.g., FIGS. 4 and 5).

In addition, some embodiments of cleaning device 10 may be configured to be operated such that scrubber members 38 are not exposed relative to the exterior of housing 24, for example, when a user desires to use only brush 46 for a relatively extended period without using scrubber members 38. For example, as shown in FIG. 6, exemplary housing 24 is configured to receive a panel 128, which covers scrubber wheel 28 and scrubber members 28, so that they are not exposed to the exterior of housing 24. Housing 24 may include retainers, such as, for example, bosses 130 and 132 provided on upper and lower portions of housing 24, respectively, for mounting panel 128 to housing 24. Panel 128 may include complimentary detents 134 and 136 for coupling (e.g., snap-fastening) to bosses 130 and 132, respectively.

Referring to FIG. 10, exemplary panel 128 includes a side partition 138 configured to enclose the normally-open opening 76 of housing 24. As shown in FIG. 12, exemplary housing 24 defines an opening 140 defining, for example, a generally crescent shape. Opening 140 provides a gap between an edge 142 of housing 24 and an inside face 144 of panel 128.

In this exemplary configuration, fluid flow, once beyond scrubber wheel 28, is advantageously directed outward through opening 140. As such, panel 128, when covering scrubber wheel 28, may operated to direct, deflect or concentrate fluid flow towards opening 140 and brush 46. According to the exemplary embodiment shown, panel 128 may further include a partial, generally-conical shaped surface 146, which extends from housing 24. Surface 146 may be separate or integral with panel 128, and is another deflecting surface configured to direct, deflect, and/or concentrate fluid flow toward brush 46. By virtue of deflecting fluid flow towards brush 46, brush 46 may be used in combination with fluid spray, the fluid spray optionally including treatment material from treatment cartridge 80. In addition, brush 46 may be driven via axle 32 and scrubber wheel 28 as fluid flows past scrubber wheel 28, as described in more detail previously herein. For example, the speed of rotation of brush 46 may be controlled via valve assembly 18 (FIG. 1) as described previously herein, and/or the amount of treatment material dispensed may be controlled via nozzle assembly 62 (i.e., via knob 120). As described previously, brush 46, panel 128, and/or surface 146 may be removed from scrubber head 14, for example, when the user no longer desires to use the brush 46, and instead desires to use scrubber wheel 28.

It will be apparent to those skilled in the art that various modifications and variations can be made to the structures and methodologies described herein. Thus, it should be understood that the invention is not limited to the subject matter discussed in the description. Rather, the present invention is intended to cover modifications and variations.

What is claimed is:

1. An apparatus for scrubbing a surface, comprising:

a fluid-powered scrubber head comprising, a housing, an inlet to the housing for receiving a flow of fluid from a fluid supply, a deflecting surface within the housing for directing the flow of fluid once received through the inlet, a wheel having an axle and being rotatably mounted within the scrubber head, and a deflecting panel movably mounted to the housing to selectively cover an opening in the housing through which at least a portion of the flow of fluid exits the housing when the deflecting panel is in a first position; and a removable brush extending from the scrubber head, the brush being rotated in response to the directed flow of fluid, the removable brush being configured to rotate about a first axis, wherein the removable brush is exterior with respect to the housing, wherein the deflecting surface is pivotable about a second axis, such that the flow of fluid is selectively directable from one side of the first axis to an opposite side of the first axis, thereby resulting in selective adjustment of the speed and direction of rotation of the brush, wherein the wheel further comprises scrubbing members disposed radially about the axle of the wheel, at least a portion of the scrubbing members extending beyond the housing when the deflecting panel is in the first position, and wherein the deflecting panel operates to contain the scrubbing members within the housing when the deflecting panel is in a second position that covers the opening.

2. The apparatus of claim 1, wherein the wheel is detachably mounted to the brush, wherein the brush extends from the wheel within the scrubber head, and wherein the deflecting surface is a nozzle within the scrubber head that directs the flow of fluid towards the wheel so as to cause rotation of the wheel and the brush extending from the wheel.

3. The apparatus of claim 1, wherein the deflecting surface selectively directs the flow of fluid towards the removable brush.

4. The apparatus of claim 1, wherein the deflecting panel defines an outlet through which the flow of fluid is redirected towards the brush and wherein the deflecting surface further comprises a partial conical surface extending from the outlet of the deflecting panel to concentrate the flow of fluid towards the brush.

5. The apparatus of claim 1, wherein the scrubber head further comprises a treatment material dispenser for holding treatment material to be applied to the surface, the treatment material dispenser being rotatable in response to the flow of fluid, wherein rotation of the treatment material dispenser permits a portion of treatment material to escape into the flow of fluid.

6. The apparatus of claim 1, wherein the brush is removably connected to the axle and rotatably fixed such that rotation of the wheel causes corresponding rotation of the brush.

7. An apparatus for scrubbing a surface, comprising:

a scrubber head comprising, a housing, an inlet at one end of the housing, the inlet for receiving a flow of fluid from a fluid supply, an adjustable nozzle within the housing for directing the flow of fluid once received through the inlet, a deflecting panel movably mounted to the housing to selectively cover an opening in the housing through which at least a portion of the flow of fluid exits the housing when the deflecting panel is in a first position, and a wheel having an axle and being rotatably mounted within the housing, the wheel receiving the directed flow of fluid from the nozzle and rotating in response to the flow of fluid from the nozzle; and a brush having a mounting shaft, the shaft being removably connected to the wheel, the brush extending from the wheel outside the housing and being responsive to rotation of the wheel, the brush being configured to rotate about a first axis, wherein the adjustable nozzle is pivotable about a second axis, such that the flow of fluid is selectively directable from one side of the first axis to an opposite side of the first axis, thereby resulting in selective adjustment of the speed and direction of rotation of the brush, wherein the wheel further comprises scrubbing members disposed radially about the axle of the wheel, at least a portion of the scrubbing members extending beyond the housing when the deflecting panel is in the first position, and wherein the deflecting panel operates to contain the scrubbing members within the housing when the deflecting panel is in a second position that covers the opening.

8. The apparatus of claim 7, wherein the deflecting panel is movably mounted to the housing to selectively redirect the flow of fluid towards the brush.

9. The apparatus of claim 8, wherein deflecting panel defines an outlet through which the flow of fluid is redirected towards the brush; and further comprising a partial conical surface extending from the outlet of the deflecting panel to concentrate the flow of fluid towards the brush.

10. The apparatus of claim 9, wherein the partial conical surface removably attaches to at least one of the housing and the deflecting panel.

11. The apparatus of claim 7, further comprising a partial conical surface extending from the housing to concentrate the flow of fluid towards the brush.

12. The apparatus of claim 7, wherein the scrubber head further comprises a treatment material dispenser for holding treatment material to be applied to the surface, the treatment material dispenser being disposed within the housing and rotatable in response to the flow of fluid, wherein rotation of the treatment material dispenser permits a portion of treatment material to escape into the flow of fluid.

13. The apparatus of claim 7, wherein the brush is removably connected to the axle and rotatably fixed relative to the axle such that rotation of the wheel causes corresponding rotation of the brush.

14. An apparatus for scrubbing a surface, comprising:

a scrubber head comprising, a housing, an inlet at one end of the housing, the inlet coupled to a fluid supply, the inlet receiving a flow of fluid from the fluid supply, an adjustable nozzle within the housing for directing the flow of fluid once received through the inlet, a treatment material dispenser removably mounted within the housing, the treatment material dispenser holding treatment material to be applied to the surface, the treatment material dispenser being rotatable in response to the flow of fluid, wherein rotation of the treatment material dispenser permits a portion of treatment material to escape into the flow of fluid, and a wheel disposed within the housing, the wheel having an axle that is rotatably mounted within the housing, the wheel and axle being rotated in response to the flow of fluid, and the wheel being configured to rotate about a first axis;

a brush comprising bristle material configured about a mounting shaft, the mounting shaft being removably connected to the axle of the wheel, wherein the brush extends from the axle and outside the housing, the brush being responsive to rotation of the wheel, wherein the scrubber head further comprises a deflecting panel movably mounted to the housing to selectively cover an opening in the housing through which at least a portion of the flow of fluid exits the housing when the deflecting panel is in a first position, the deflecting panel being disposed on the housing to direct the portion of the flow of fluid towards the removable brush when the deflecting panel is in a second position that covers the opening in the housing, wherein the adjustable nozzle is pivotable about a second axis, such that the flow of fluid is selectively directable from one side of the first axis to an opposite side of the first axis, thereby resulting in selective adjustment of the speed and direction of rotation of the brush, wherein the wheel further comprises scrubbing members disposed radially about the axle of the wheel, at least a portion of the scrubbing members extending beyond the housing when the deflecting panel is in the first position, and wherein the deflecting panel operates to contain the scrubbing members within the housing when the deflecting panel is in the second position that covers the opening.

15. The apparatus of claim 14, wherein the wheel is removable from the housing for replacement.

16. The apparatus of claim 14, wherein the deflecting panel defines an outlet through which the flow of fluid is redirected towards the brush when the deflecting panel covers the opening; and further comprising a partial conical surface extending from the outlet of the deflecting panel to concentrate the flow of fluid towards the brush.

17. The apparatus of claim 16, wherein the partial conical surface removably attaches to at least one of the housing and the deflecting panel.

18. The apparatus of claim 14, wherein rotation of the axle causes corresponding rotation of the brush as the fluid flow is directed towards the brush.

* * * * *